US010014594B1

(12) United States Patent
Wu

(10) Patent No.: US 10,014,594 B1
(45) Date of Patent: Jul. 3, 2018

(54) TERMINAL BLOCK ASSEMBLY AND WIRING WRENCH THEREOF

(71) Applicants: DINKLE ENTERPRISE CO., LTD., New Taipei (TW); DINKLE ELECTRIC MACHINERY (CHINA) CO., LTD., Kunshan, Jiangsu (CN)

(72) Inventor: Shang-Tsai Wu, New Taipei (TW)

(73) Assignees: DINKLE ENTERPRISE CO., LTD., New Taipei (TW); DINKLE ELECTRIC MACHINERY (CHINA) CO., LTD., Kunshan, Jiangsu (CN)

( * ) Notice: Subject to any disclaimer, the term of this patent is extended or adjusted under 35 U.S.C. 154(b) by 0 days.

(21) Appl. No.: 15/698,621

(22) Filed: Sep. 7, 2017

(51) Int. Cl.
*H01R 4/48* (2006.01)

(52) U.S. Cl.
CPC ..... *H01R 4/4827* (2013.01); *H01R 4/4845* (2013.01)

(58) Field of Classification Search
CPC ..... H01R 4/4827; H01R 4/4845
USPC ..... 439/370, 725, 835, 268, 729, 441
See application file for complete search history.

(56) References Cited

U.S. PATENT DOCUMENTS 2,549,589 A * 4/1951 Flynn ..... H01R 11/24 439/729
9,397,444 B1 * 7/2016 Wu ..... H01R 4/4845
9,543,666 B2 * 1/2017 Wendt ..... H01R 4/5008
9,761,961 B2 * 9/2017 Wendt ..... H01R 4/4827
2010/0197159 A1 * 8/2010 Gosis ..... H01R 13/193 439/370
2015/0044897 A1 * 2/2015 Wu ..... H01R 4/48 439/352
2016/0190713 A1 * 6/2016 Wu ..... H01R 4/4836 439/733.1

FOREIGN PATENT DOCUMENTS

DE 102015100823 A1 7/2016
DE 102015122143 A1 6/2017
EP 1189307 A2 3/2002
EP 1309036 A1 5/2003
EP 1641079 A1 3/2006

OTHER PUBLICATIONS

Search Report dated Mar. 21, 2018 of the corresponding European patent application.

* cited by examiner

*Primary Examiner* — Edwin A. Leon
*Assistant Examiner* — Oscar Jimenez
(74) *Attorney, Agent, or Firm* — Chun-Ming Shih; HDLS IPR Services

(57) ABSTRACT

Disclosed are a terminal block assembly (10) and its wiring wrench (2). The wiring wrench (2) includes a press rod (21) and a handle (22), and the press rod (21) has a pressing protruding arm (211) on a side and a stop portion (212) on the other side, and the handle (22) and the press rod (21) are connected by a pivoting structure (23), and the handle (22) has a clamping protruding arm (221) on a side and an elastic arm (222) on the other side, and the clamping protruding arm (221) and the pressing protruding arm (211) are configured to be opposite to each other, and the elastic arm (222) may selectively abut at the stop portion (212). Therefore, the wiring wrench (2) can be latched securely with the terminal block (1) to provide the effect of latching the terminal block (1) conveniently.

9 Claims, 8 Drawing Sheets

TERMINAL BLOCK ASSEMBLY AND WIRING WRENCH THEREOF

FIELD OF THE INVENTION

This disclosure generally relates to the field of hand tools used for wiring, and more particularly to a terminal block assembly and its wiring wrench.

BACKGROUND OF THE INVENTION

Terminal block is used extensively in machines and equipments (such as industrial computers, uninterrupted power supply systems, power supply devices, etc.), industrial control equipments (such as electromechanical systems, refrigerated air conditioners, programmable controllers, etc.) or electrical appliances (such as air conditioners, refrigerators, washers, ovens, etc.), and provided an electrical connection device for connecting a plurality of electrically conductive wires.

A conventional terminal block is generally comprised of an insulating base and an electrically conductive terminal, and the insulating base has a bracket installed therein and provided for fixing a cable, and then the cable is inserted into the insulating base by a screwdriver and electrically coupled to an electrically conductive terminal, and finally the screwdriver is removed, so that the bracket presses and positions the cable in the insulating base.

However, the screwdriver is not a tool designed for wiring, so that the aforementioned wiring operation will be relatively inconvenient, and the terminal block may be damaged easily if the screwdriver is used inadvertently. Therefore, it is a main subject for related manufacturers to improve the wiring operation of the terminal block.

SUMMARY OF THE INVENTION

Therefore, it is a primary objective of this disclosure to provide a terminal block assembly and its wiring wrench, wherein an elastic arm is provided for driving a pressing protruding arm and a clamping protruding arm to move in a direction approaching one another, so that a wiring wrench can be latched to the terminal block securely, so as to achieve the advantage of latching the terminal block securely by the wiring wrench.

To achieve the aforementioned and other objectives, this disclosure provides a wiring wrench comprising: a press rod, having a pressing protruding arm disposed on a side of the press rod, and a stop portion extended from the other side of the press rod; and a handle and a press rod, coupled by a pivoting structure, and the handle having a clamping protruding arm extended from a side of the handle and an elastic arm extended from the other side of the handle, and the clamping protruding arm and the pressing protruding arm being configured to be opposite to each other, and the elastic arm selectively abutting the stop portion.

To achieve the aforementioned and other objectives, this disclosure further provides a terminal block assembly comprising a terminal block, comprising: an insulating base, having at least one inserting slot formed on the insulating base and a positioning protrusion extended from the insulating base, and the positioning protrusion having a holding portion disposed at an end of the positioning protrusion and a drill slot formed at the other end of the positioning protrusion and communicated to the inserting slot; and at least one pulling member, movably passed and coupled to the drill slot, and having a pressing portion with the exposed drill slot; and a wiring wrench, comprising: a press rod, having a pressing protruding arm disposed on a side of the press rod and a stop portion extended from the other side of the press rod; and a handle, coupled to the press rod by a pivoting structure, and having a clamping protruding arm extended from a side of the handle and an elastic arm extended from the other side of the handle, and the clamping protruding arm and the pressing protruding arm being configured to be opposite to each other, and the elastic arm being capable of selectively abutting the stop portion; thereby, when the pressing protruding arm and the clamping protruding arm are clamped at the holding portion and the pressing portion respectively, the elastic arm abuts the stop portion to drive the pressing protruding arm and the clamping protruding arm to move in a direction approaching one another.

DESCRIPTION OF THE PREFERRED EMBODIMENTS

Figure 1:
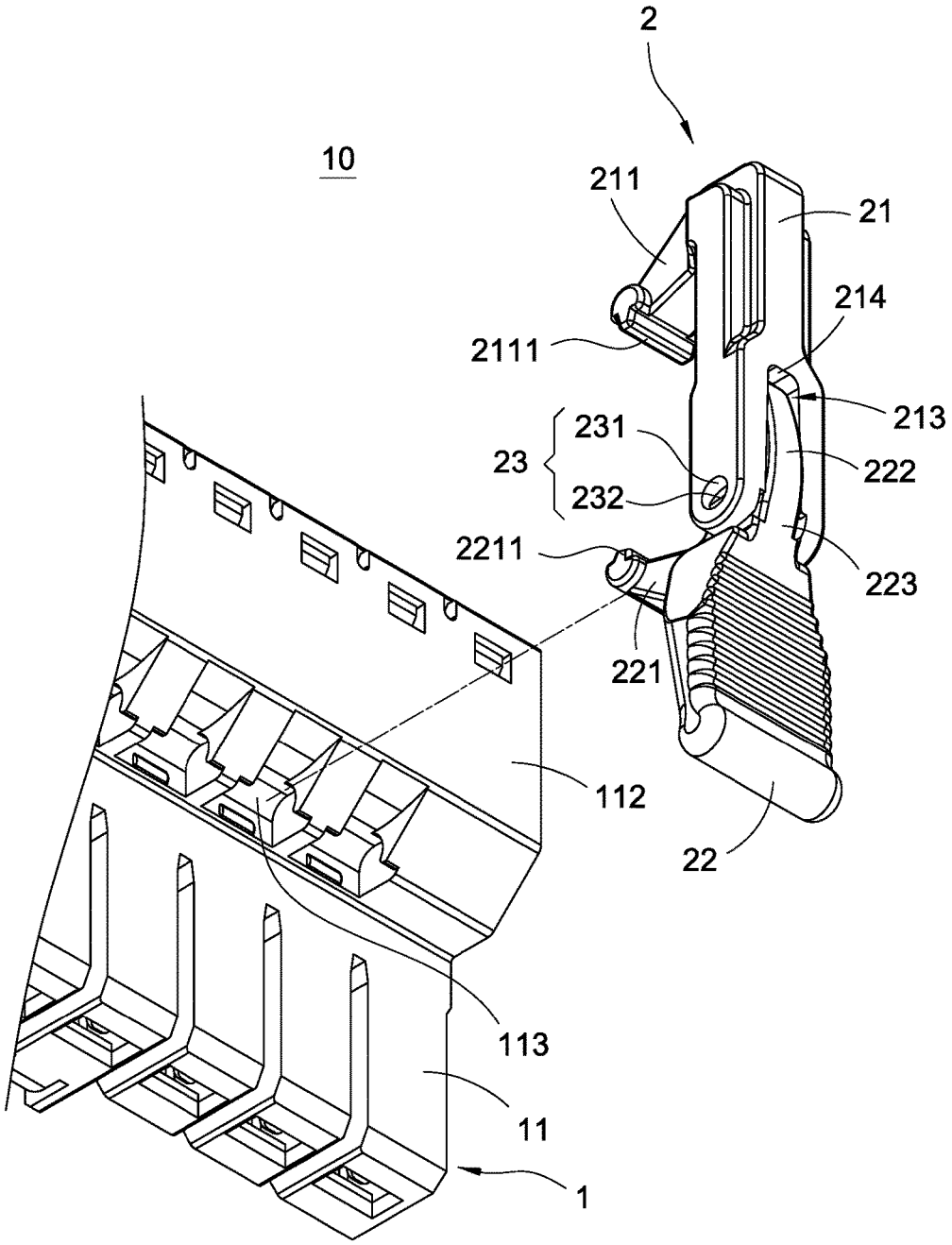
FIG. 1 is a perspective view of a wiring wrench of this disclosure.
Figure 2:
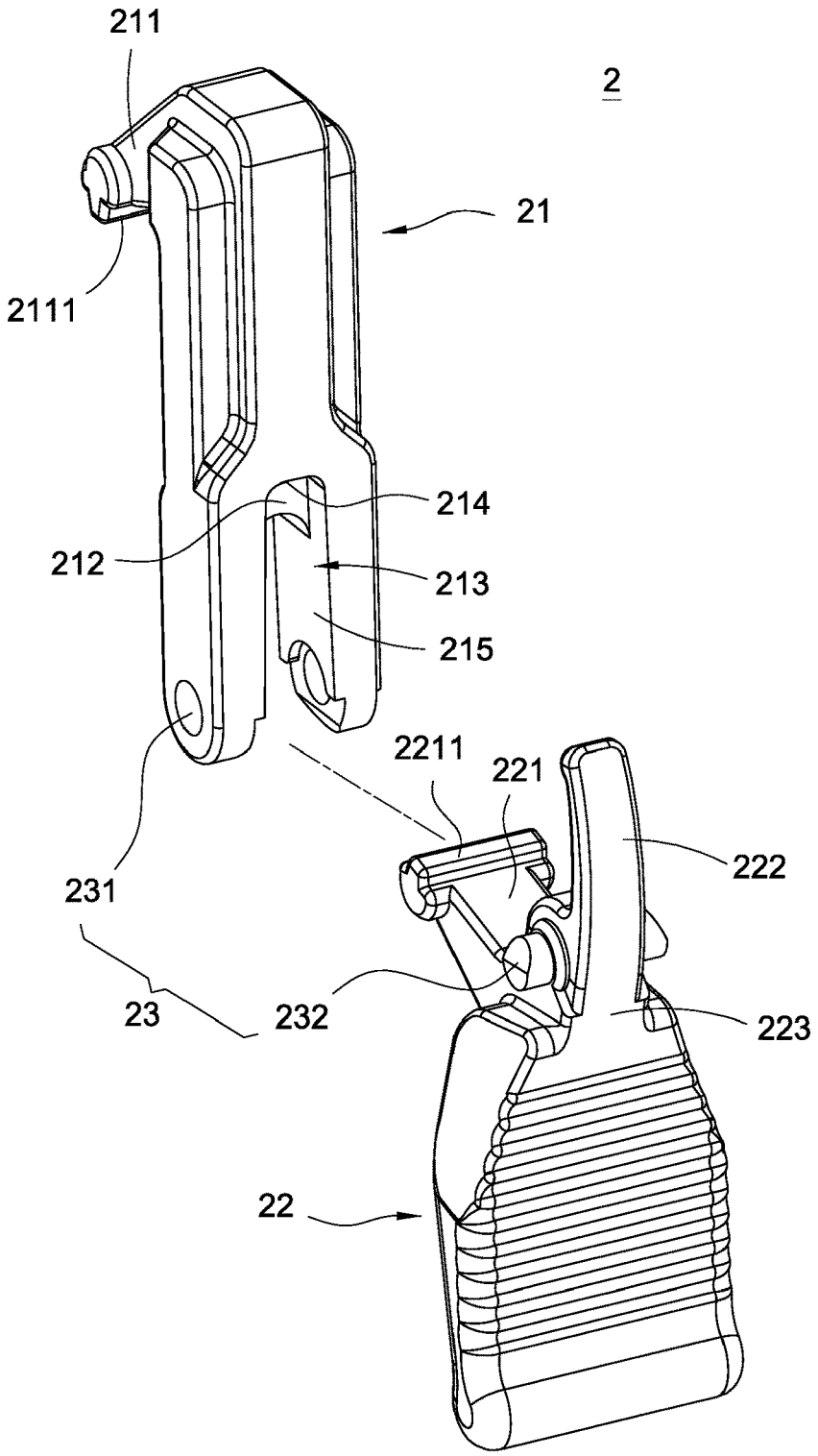
FIG. 2 is an exploded view of a wiring wrench of this disclosure.
Figure 3:
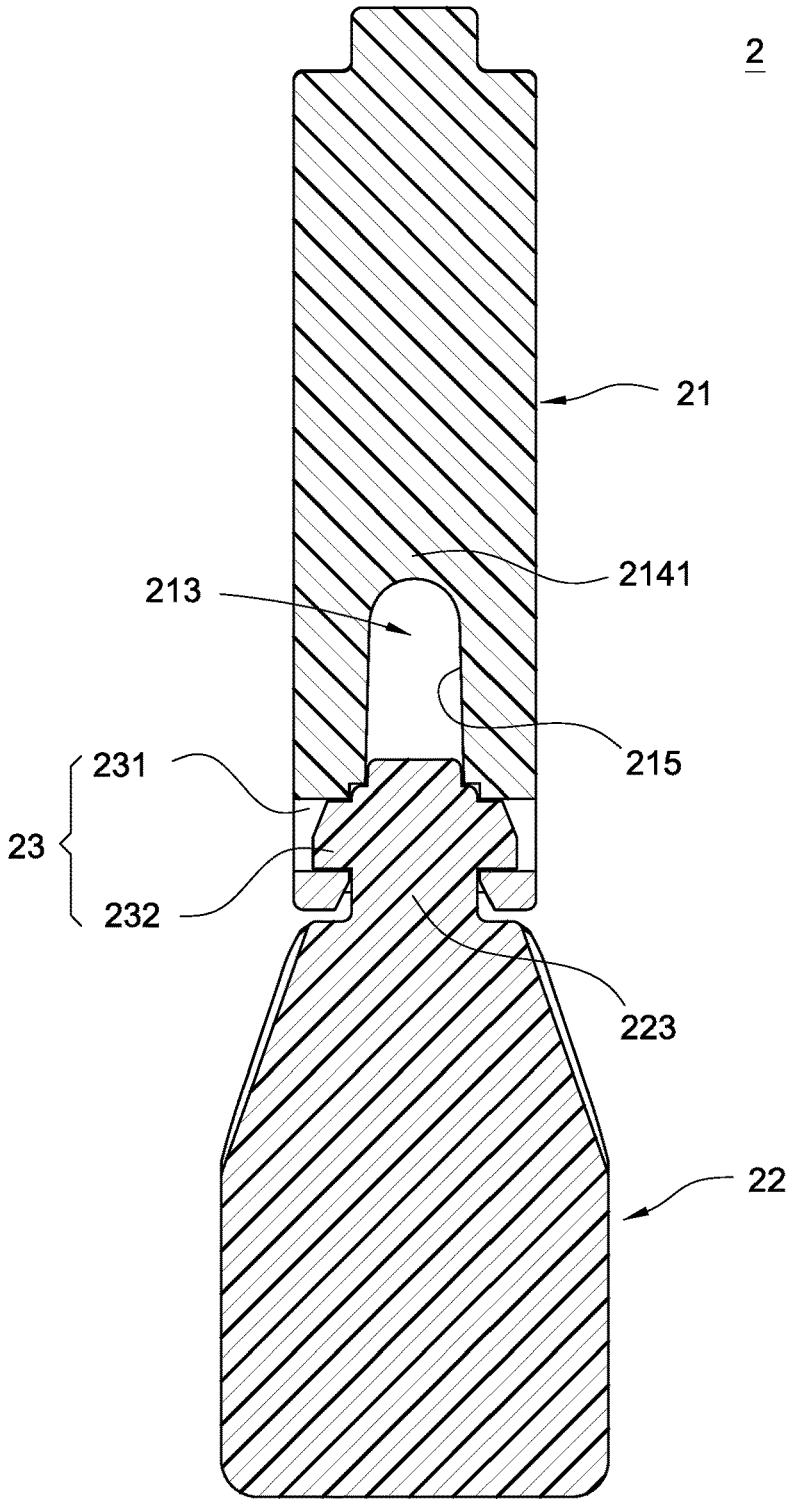
FIG. 3 is a sectional view of a wiring wrench of this disclosure.
Figure 4:
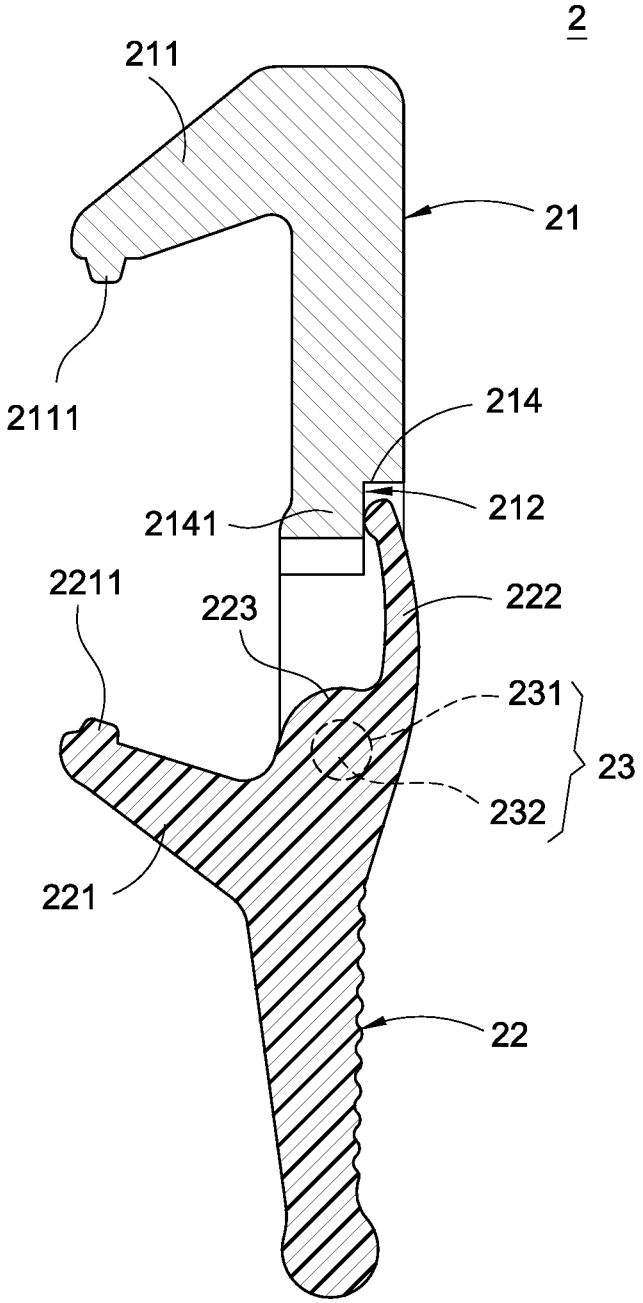
FIG. 4 is another sectional view of a wiring wrench of this disclosure.

The technical contents of this disclosure will become apparent with the detailed description of preferred embodiments accompanied with the illustration of related drawings as follows. It is noteworthy that same numerals are used for representing same respective elements in the drawings.

With reference to FIG. 1 to for a terminal block assembly and its wiring wrench in accordance with this disclosure, the terminal block assembly 10 comprises a terminal block 1 and a wiring wrench 2; and the wiring wrench 2 comprises a press rod 21 and a handle 22.

In FIGS. 1, and 5 to 8, the terminal block 1 comprises an insulating base 11, one or more pulling members 12, one or more electrically conductive terminals 13 and one or more brackets 14.

Wherein, the insulating base 11 has at least one inserting slot 111 formed thereon and a positioning protrusion 112 extended therefrom, and the positioning protrusion 112 has a holding portion 113 at an end and a drill slot 114 formed at the other end and communicated to the inserting slot 111.

In addition, the pulling member 12 is movably passed and coupled to the drill slot 114, and the pulling member 12 has a pressing portion 121 exposed from the drill slot 114, and the pressing portion 121 has a notch 1211.

In addition, the electrically conductive terminal 13 and the bracket 14 are installed in the inserting slot 111, and the bracket 14 is installed between the pulling member 12 and the electrically conductive terminal 13, and the pulling member 12 abuts the bracket 14 and drives the bracket 14 to seal or open the inserting slot 111.

In FIGS. 1 to 8, the press rod 21 has a pressing protruding arm 211 on one side and a stop portion 212 on the other side, and a hollow through groove 213 is inwardly formed at an end of the press rod 21 away from the pressing protruding arm 211, and the hollow through groove 213 has a bottom wall 214 therein and two opposite inner sidewalls 215, and the stop portion 212 includes a stopper 2141 extended outwardly from the bottom wall 214.

In FIGS. 1 to 8, the handle 22 and the press rod 21 are coupled with each other by a pivoting structure 23, and the handle 22 has a clamping protruding arm 221 extended from a side and an elastic arm 222 extended from the other side, and clamping protruding arm 221 and pressing protruding arm 211 are disposed opposite to each other, and the elastic arm 222 selectively abuts the stop portion 212. In other words, the elastic arm 222 abuts or stays away from the stop portion 212. Wherein, the handle 22 is made of plastic or metal, so that the outwardly extended and formed elastic arm 222 has a specific elasticity.

Specifically, the elastic arm 222 is embeddable into hollow through groove 213 and capable of selectively abutting the stopper 2141. In other words, the elastic arm 222 may abut against or stay away from the stopper 2141.

In addition, the pressing protruding arm 211 has a first latch 2111 extended towards the clamping protruding arm 221, and the clamping protruding arm 221 has a second latch 2211 extended towards the pressing protruding arm 211, and one of the first latch 2111 and the second latch 2211 is embeddable into the notch 1211.

In addition, the handle 22 has a shaft block 223 extended in a direction towards the press rod 21, and the pivoting structure 23 includes two pivot holes 231 formed on two inner sidewalls 215 respectively, and two pivot columns 232 extended from both sides of the shaft block 223 respectively, and the shaft block 223 is accommodated in the hollow through groove 213, and the two pivot columns 232 are respectively and pivotally coupled to two pivot holes 231, and the clamping protruding arm 221 and the elastic arm 222 are extended from two opposite sides of the shaft block 223 respectively.

When the pressing protruding arm 211 and the clamping protruding arm 221 are clamped at the holding portion 113 and the pressing portion 121 respectively, the elastic arm 222 abuts the stop portion 211 to drive the pressing protruding arm 211 and the clamping protruding arm 221 to move in a direction approaching one another.

Figure 5:
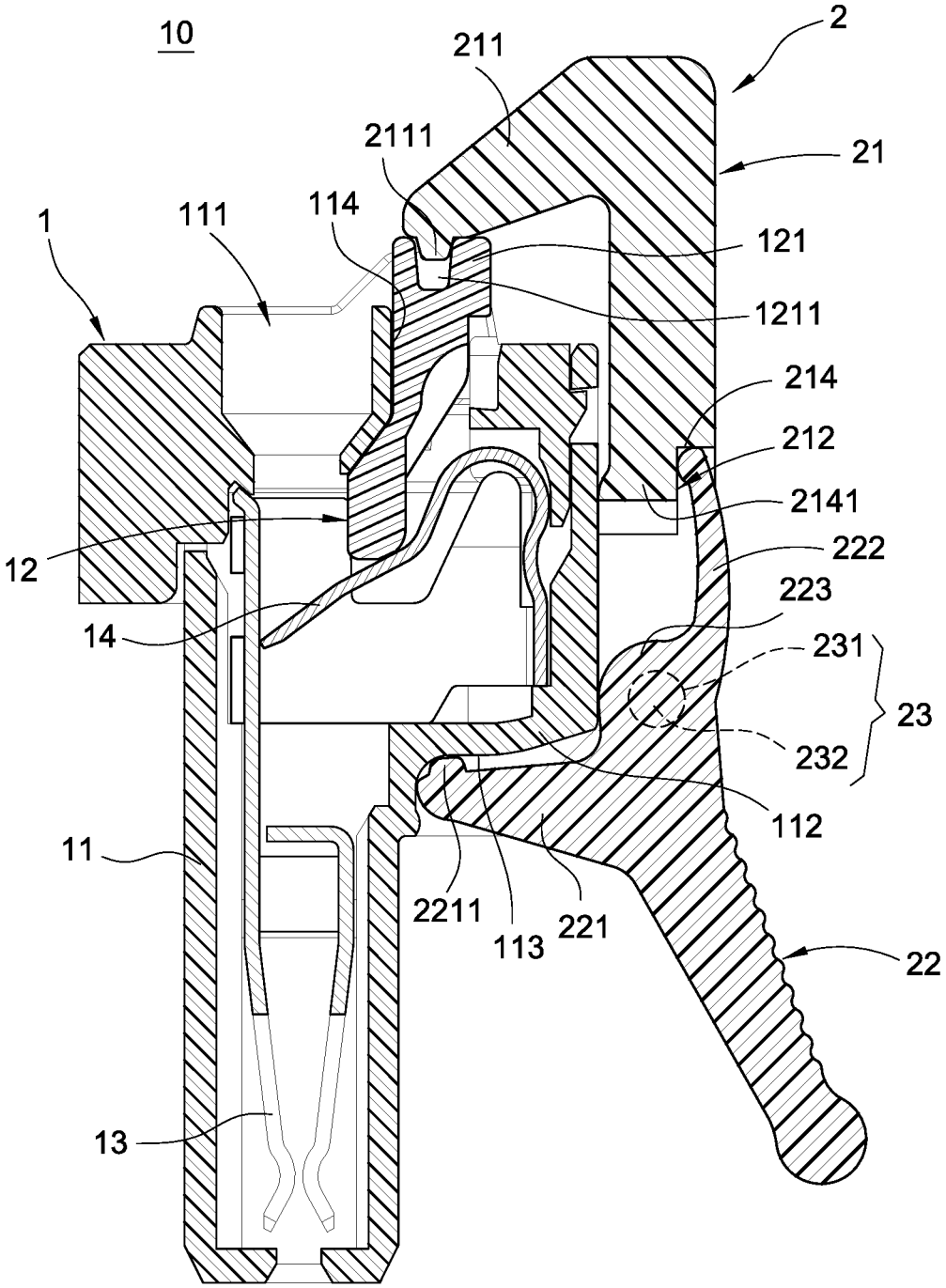
FIG. 5 is a schematic view showing a first using status of a wiring wrench of this disclosure.

With reference to FIGS. 5 to 8 for different using statuses of a terminal block assembly 1 and its wiring wrench 2 in accordance with this disclosure, FIG. 5 shows that when the pressing protruding arm 211 and the clamping protruding arm 221 are clamped at the holding portion 113 and the pressing portion 121 respectively, the elastic arm 222 abuts the stop portion 211, so as to provide a reaction to the pressing protruding arm 211 and the clamping protruding arm 221 to drive the pressing protruding arm 211 and the clamping protruding arm 221 to move in a direction approaching one another, so that the pressing protruding arm 211 and the clamping protruding arm 221 jointly and securely clamp the holding portion 113 and the pressing portion 121, and the wiring wrench 2 can be latched to the terminal block 1 securely to achieve the effect of latching the wiring wrench 2 to the terminal block 1 conveniently.

Figure 6:
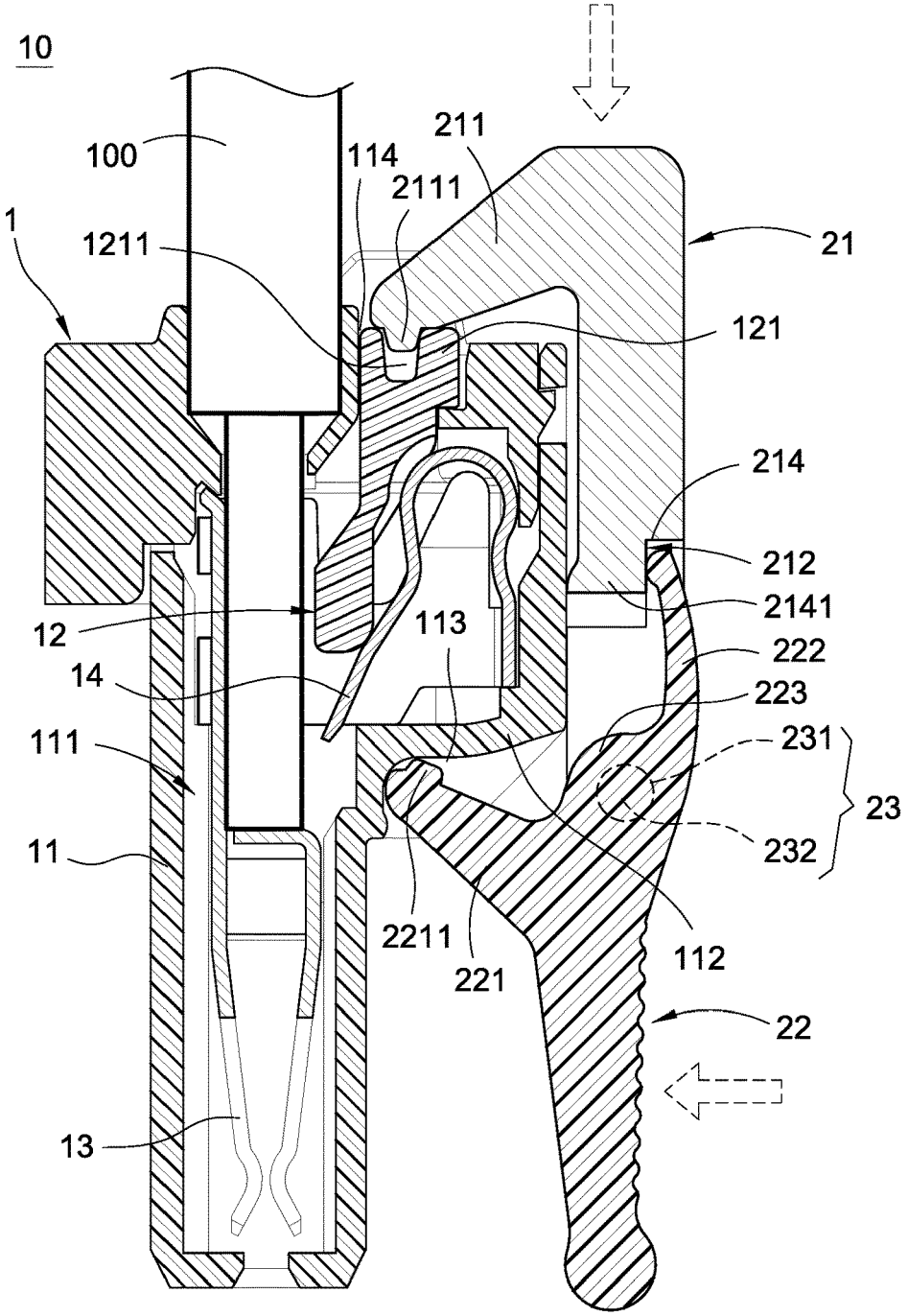
FIG. 6 is a schematic view showing a second using status of a wiring wrench of this disclosure.

In FIG. 6, the terminal block 1 of this preferred embodiment includes but not limited to a PID terminal block, and the PID terminal block can insert a cable 100 into the inserting slot 111 without requiring any tool, since the cable 100 can prop open the bracket 14 by its hardness and electrically connecting the electrically conductive terminal 13. After the cable 100 props open the bracket 14, the pressing portion 121 will move downwardly with the bracket 14, and the pressing protruding arm 211 and the clamping protruding arm 221 will approach each other under the action of the elastic arm 222, while the wiring wrench 2 can still latch the terminal block 1 securely.

When the terminal block 1 is not a PID terminal block, the handle 22 is pivoted in a direction towards the terminal block 1 to drive the pressing protruding arm 212 and the clamping protruding arm 221 to become closer to each other, so that the pressing portion 121 is pressed deeply into the drill slot 114. Now, the pulling member 12 will abut the bracket 14, so that the bracket 14 swings downwardly to open the inserting slot 111, and the cable 100 may be inserted into the open inserting slot 111 and electrically coupled to the electrically conductive terminal 13.

Figure 7:
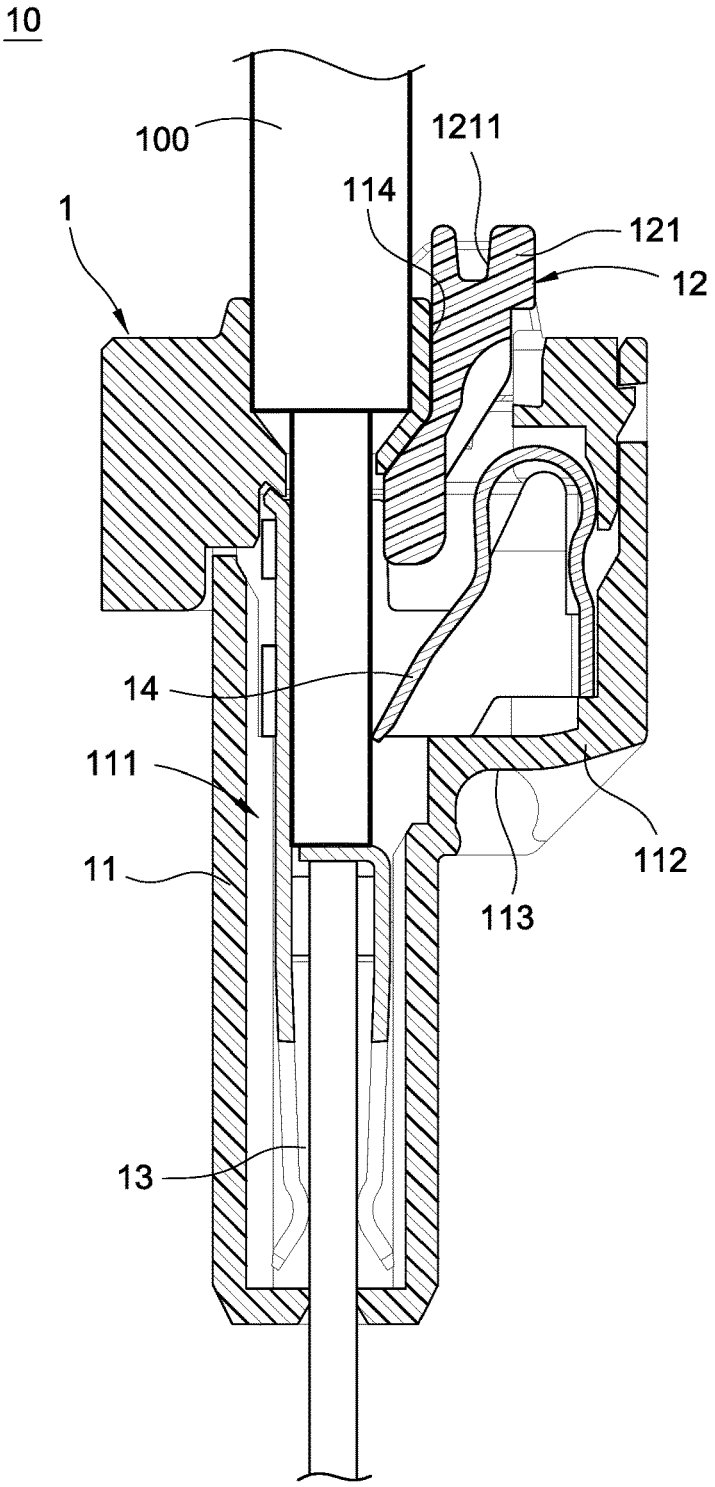
FIG. 7 is a schematic view showing a third using status of a wiring wrench of this disclosure.

In FIG. 7, after the force applied for pivoting the handle 22 towards the terminal block 1 is released, the handle 22 will be pivoted in a direction away from the terminal block 1, so that the pressing protruding arm 212 and the clamping protruding arm 221 are separated apart, and the original downward force exerted on the bracket 14 disappears, and the bracket 14 will swing upwardly to resume its original position and intend to close the inserting slot 111. However, the cable 100 has already been inserted in the inserting slot 111, so that the bracket 14 will be blocked by the cable 100. In the meantime, the cable 100 is clamped and positioned between an inner wall of the inserting slot 111 and the bracket 14.

Figure 8:
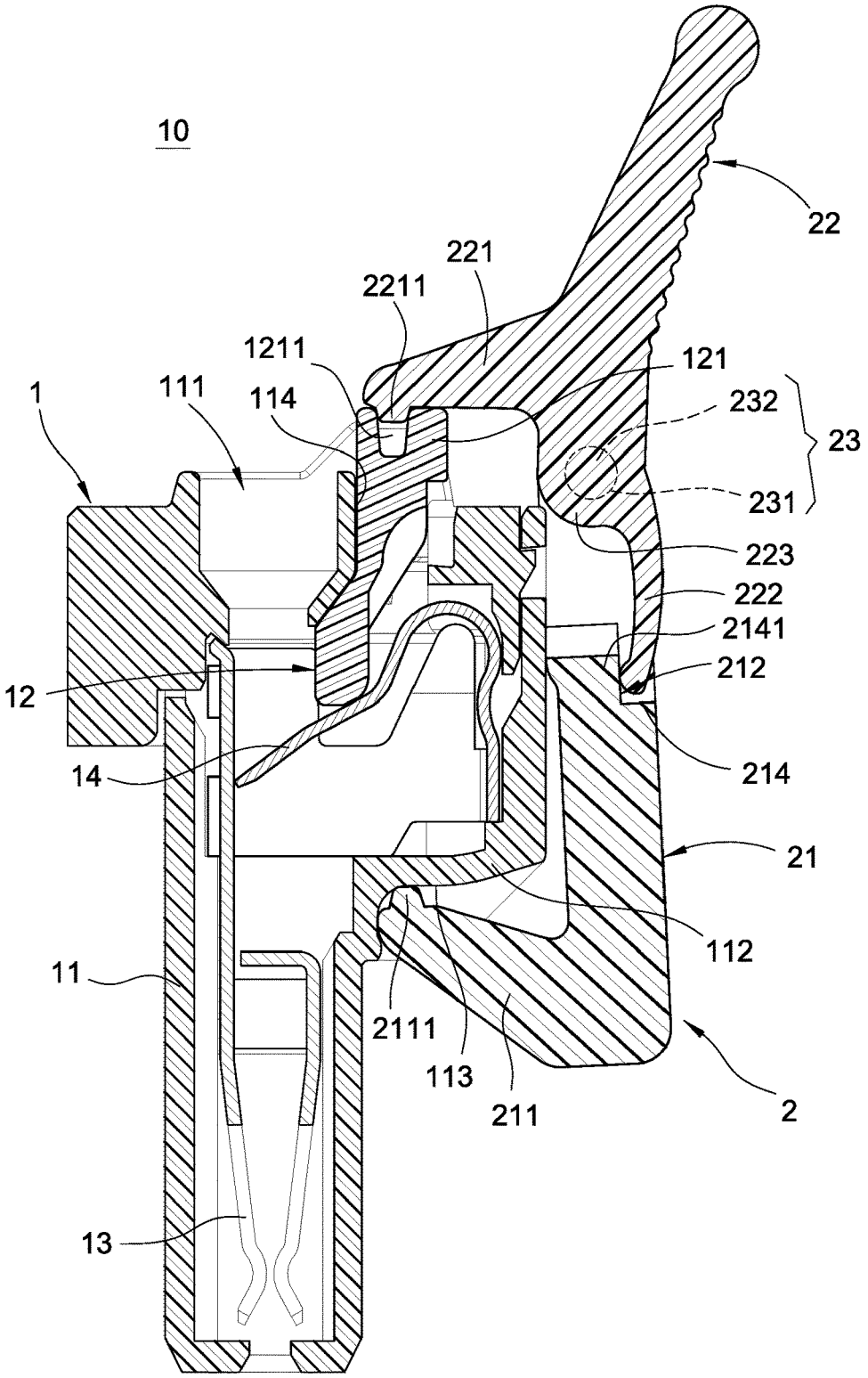
FIG. 8 is a schematic view showing a fourth using status of a wiring wrench of this disclosure.

In FIGS. 5 and 8, the pressing portion 121 has a notch 1211, and the first latch 2111 of the pressing protruding arm 211 and the second latch 2211 of the clamping protruding arm 221 are embeddable into the notch 1211, so that the wiring wrench 2 can be engaged with the pressing portion 121 more securely to achieve the effect of pressing the pressing portion 121 effectively by the wiring wrench 2.

In addition, the wiring wrench 2 of this disclosure may be rotated in a forward direction or a reverse direction to achieve the aforementioned operational relation and effect. In FIG. 5, the pressing protruding arm 211 abuts the pressing portion 121, and the clamping protruding arm 221 abuts the holding portion 113, and the first latch 2111 of the pressing protruding arm 211 is embedded into the notch 1211, so that the wiring wrench 2 can be rotated in the forward direction to latch the terminal block 1 securely. In FIG. 8, the pressing protruding arm 211 abuts the holding portion 113, and the clamping protruding arm 221 abuts the pressing portion 121, and the second latch 2211 of the clamping protruding arm 221 is embedded into the notch 1211, so that the wiring wrench 2 can be rotated in the reverse direction to latch the terminal block 1 securely.

In summation of the description above, this disclosure achieves the expected objectives and overcomes the drawbacks of the prior art, and this disclosure complies with patent application requirements, and is thus duly filed for patent application.

While this disclosure has been described by means of specific embodiments, numerous modifications and variations could be made thereto by those skilled in the art without departing from the scope and spirit of this disclosure set forth in the claims.

What is claimed is:

1. A wiring wrench, comprising: a press rod (21), having a pressing protruding arm (211) disposed on a side of the press rod (21), and a stop portion (212) extended from another side of the press rod (21); and a handle (22) coupled to the press rod (21) by a pivoting structure (23), and the handle (22) having a clamping protruding arm (221) extended from a side of the handle (22) and an elastic arm (222) extended from another side of the handle (22), and the clamping protruding arm (221) and the pressing protruding arm (211) being configured to be opposite to each other, and the elastic arm (222) selectively abutting the stop portion (212); wherein the press rod (21) has a hollow through groove (213) inwardly formed at an end away from the pressing protruding arm (211), and the hollow through groove (213) has a bottom wall (214) therein, and the stop portion (212) includes a stopper (2141) extended outwardly from the bottom wall (214), and the elastic arm (222) is embeddable into the hollow through groove (213) and capable of selectively abutting the stopper (2141).

2. The wiring wrench of claim 1, wherein the hollow through groove (213) has two opposite inner sidewalls (215) therein, and the handle (22) has a shaft block (223) extended in a direction towards the press rod (21), and the pivoting structure (23) includes two pivot holes (231) formed on the two inner sidewalls (215) respectively, and two pivot columns (232) extended from both sides of the shaft block (223) respectively, and the shaft block (223) is accommodated in the hollow through groove (213), and the two pivot columns (232) are respectively and pivotally coupled to the two pivot holes (231).

3. The wiring wrench of claim 2, wherein the clamping protruding arm (221) and the elastic arm (222) are formed and extended from two opposite sides of the shaft block (223) respectively, and the pressing protruding arm (211) has a first latch (2111) extended towards the clamping protruding arm (221), and the clamping protruding arm (221) has a second latch (2211) extended towards the pressing protruding arm (211).

4. A terminal block assembly, comprising: a terminal block (1), comprising: an insulating base (11), having at least one inserting slot (111) formed on the insulating base (11) and a positioning protrusion (112) extended from the insulating base (22), and the positioning protrusion (112) having a holding portion (113) disposed at an end of the positioning protrusion (112) and a drill slot (114) formed at another end of the positioning protrusion (112) and communicated to the inserting slot (111); and at least one pulling member (12), movably passed and coupled to the drill slot (114), and having a pressing portion (121) with the exposed drill slot (114); and a wiring wrench (2), comprising: a press rod (21), having a pressing protruding arm (211) disposed on a side of the press rod (21) and a stop portion (212) extended from another side of the press rod (21); and a handle (22), coupled to the press rod (21) by a pivoting structure (23), and having a clamping protruding arm (221) extended from a side of the handle (22) and an elastic arm (222) extended from another side of the handle (22), and the clamping protruding arm (221) and the pressing protruding arm (211) being configured to be opposite to each other, and the elastic arm (222) being capable of selectively abutting the stop portion (212); thereby, when the pressing protruding arm (211) and the clamping protruding arm (221) are clamped at the holding portion (113) and the pressing portion (121) respectively, the elastic arm (222) abuts the stop portion (212) to drive the pressing protruding arm (211) and the clamping protruding arm (221) to move in a direction approaching one another.

5. The terminal block assembly of claim 4, wherein the press rod (21) has a hollow through groove (213) inwardly formed at an end away from the pressing protruding arm (211), and the hollow through groove (213) has a bottom wall (214) therein, and the stop portion (212) includes a stopper (2141) extended outwardly from the bottom wall (214), and the elastic arm (222) is embeddable into the hollow through groove (213) and capable of selectively abutting the stopper (2141).

6. The terminal block assembly of claim 5, wherein the hollow through groove (213) has two opposite inner sidewalls (215) therein, and the handle (22) has a shaft block (223) extended in a direction towards the press rod (21), and the pivoting structure (23) includes two pivot holes (231) formed on the two inner sidewalls (215) respectively, and two pivot columns (232) extended from both sides of the shaft block (223) respectively, and the shaft block (223) is accommodated in the hollow through groove (213), and the two pivot columns (232) are pivotally coupled to the two pivot holes (231) respectively.

7. The terminal block assembly of claim 6, wherein the clamping protruding arm (221) and the elastic arm (222) are formed and extended from two opposite side of the shaft block (223) respectively.

8. The terminal block assembly of claim 7, wherein the pressing portion (121) has a notch (1211), and the pressing protruding arm (211) has a first latch (2111) extended towards the clamping protruding arm (221), and the clamping protruding arm (221) has a second latch (2211) extended towards the pressing protruding arm (211), and one of the first latch (2111) and the second latch (2211) is embeddable into the notch (1211).

9. The terminal block assembly of claim 8, wherein the terminal block (1) further includes at least one electrically conductive terminal (13) and at least one bracket (14), and the electrically conductive terminal (13) and the bracket (14) are installed in the inserting slot (111), and the bracket (14) is installed between the pulling member (12) and the electrically conductive terminal (13), and the pulling member (12) abuts the bracket (14) and drives the bracket (14) to seal or open the inserting slot (111).

* * * * *